US005090586A

United States Patent [19]

Mitchell

[11] Patent Number: 5,090,586

[45] Date of Patent: Feb. 25, 1992

[54] DUAL WALL TANK

[75] Inventor: A. Ross Mitchell, Mississauga, Canada

[73] Assignee: Madison Chemical Industries Inc., Milton, Canada

[21] Appl. No.: 625,478

[22] Filed: Dec. 11, 1990

Related U.S. Application Data

[62] Division of Ser. No. 347,163, May 2, 1989, Pat. No. 4,993,581.

[51] Int. Cl.[5] ..... B65D 90/04

[52] U.S. Cl. ..... 220/453; 220/590

[58] Field of Search ..... 220/453, 454, 457, 452, 220/3, 3.1

[56] References Cited

U.S. PATENT DOCUMENTS

| | | | |
|---|---|---|---|
| 3,391,823 | 9/1968 | Tijms | 220/457 X |
| 3,814,275 | 6/1974 | Lemons | 220/453 |
| 3,901,281 | 8/1975 | Morrisey | 220/457 |
| 4,360,124 | 11/1982 | Knows et al. | 220/457 X |
| 4,592,950 | 6/1986 | Le Touche | 220/452 |
| 4,844,287 | 7/1989 | Long | 220/455 X |

*Primary Examiner*—Joseph Man-Fu Moy

*Attorney, Agent, or Firm*—Eugene J. A. Gierczak

[57] ABSTRACT

A method for making a dual wall tank for storing fluids by producing an inner wall for storing the said fluid, positioning a fabric exteriorally against the inner wall, applying a liquid resin exteriorally to the fabric so as to penetrate partially into the fabric, and curing the liquid resin so as to form simultaneously an outer wall for containing any leakage of the fluid from the inner wall and an interstice consisting of an intermediate layer of fabric permeable to any leakage of the fluid through the first wall; and includes the dual wall container formed thereby.

15 Claims, 1 Drawing Sheet

DUAL WALL TANK

This is a division of application Ser. No. 07/347,163, filed 05/02/89 now U.S. Pat. No. 4,993,581.

FIELD OF INVENTION

This invention relates to a dual wall tank for storing fluids and in particular relates to a dual wall storage tank for liquids and the method of making same.

BACKGROUND TO THE INVENTION

Storage tanks for commercial and industrial purposes are widely used for storing a variety of liquids. These storage tanks may either be located above or below ground and are adapted to contain a variety of fluids some of which are toxic or flammable. For example, a large number of storage tanks are commonly used for storing gasoline below ground at service stations and above ground at refineries and storage depots.

Over time, metal storage tanks become corroded and perforate whereby the fluids or liquids which are stored therein leak or seep into the environment. Fibreglass tanks are susceptible to cracking, embrittlement, chemical attack and similar modes of failure, often sudden in nature, leading to leakage. This leakage creates environmental hazards as well as a potentially dangerous health risk to the public at large. Accordingly, a number of secondary containment devices have heretofore been developed to minimize the environmental hazards and dangers referred to above.

For example, U.S. Pat. No, 4,625,892 teaches a polyolefin lined tank consisting of a rigid pololefin tank within a metallic tank wherein there is no adherence or bonding between the walls of the inner polyolefin tank and the outer metallic tank.

Moreover, U.S. Pat. No. 4,651,893 illustrates a double-walled tank, or tank within a tank assembly comprising an inner tank, and outer tank, and spacer means for being positioned between and securely joined to the inner and outer tanks for defining a multi-channelled passage way between the inner and outer tank to allow for an leakage of fluid from the inner tank to pass there through.

U.S. Pat. No. 4,523,454 discloses a jacketing method consisting of a rigid inner tank encased by a flexible outer jacket with a leak detection means associated with the closed space between the tank and the jacket. This patent teaches the use of sheets of various materials such as rubber and the like. The resulting product is a jacketed single wall tank rather than a dual wall tank.

Another jacketing arrangement is disclosed in U.S. Pat. No. 4,685,327 which teaches a rigid inner tank with a manhead, a sleeve encompassing the manhead, a jacket encasing the inner tank and at least a part of the sleeve, and a dispensing line extending through the manhead into the storage tank's interior.

U.S. Pat. No. 4,607,522 is a continuation-in-part of U.S. Pat. No. 4,523,454 and illustrates a storage tank system for storing gasoline which comprises a rigid inner tank encased by a flexible outer jacket with a leak detecting means associated with the closed space between the inner tank and jacket and with a separate and distinct gas pervious material positioned between the tank and the jacket.

U.S. Pat. No. 4,653,312 teaches a method of making a jacketed storage tank which comprises applying a separating agent over the storage tank, applying a layer of fibrous reinforcing material on the separating agent, and thereafter applying a resinous material.

Finally, U.S. Pat. No. 4,640,439 discribes a double wall tank manufactured from a single wall tank by applying a spacing material to at least a portion of the exterior of the inner tank, stretching an imperforate film over the spacing material and finally applying a rigid outer sheath over top of the imperforate layer.

The storage tanks and methods of constructing same which have heretofore been employed present either relatively complicated structures or require methods of construction which are relatively time-consuming and expensive to complete or which require several distinct steps or separately applied layers.

It is an object of this invention to provide an improved method of making dual wall containers and in particular an improved method of constructing dual wall storage tanks for liquids.

It is a further object of this invention to provide an improved dual tank container and in particular, to provide a dual wall tank for storing liquids.

The broadest aspect of this invention relates to a method of making a dual wall container for storing fluids by: producing an inner wall for storing said fluid; positioning a fabric exteriorally against said inner wall; and then applying a liquid resin exteriorally to said fabric so as to penetrate partially into said fabric such that, upon curing of said liquid resin, there is formed an outer wall for containing leakage of said fluid through said inner wall and an intermediate layer of fabric permeable to leakage of said fluid through said inner wall.

It is another aspect of this invention to provide a method of making a dual wall tank from a primary container adapted to store fluids, said primary container defining an inner wall, said method including the steps of: positioning fabric exteriorally against said inner wall; and then applying a liquid resin exteriorally to said fabric so as to penetrate partially into said fabric such that, upon curing of said liquid resin, there is formed an outer wall of cured resin for containing leakage of said fluid through said inner wall, a combined layer of fabric means penetrated with cured resin means, said combined layer integrally connected to said outer wall, and an intermediate layer of unpenetrated fabric disposed adjacent said inner wall, said intermediate layer permeable to leakage of said fluid from said inner wall.

It is another aspect of this invention to provide a method of manufacturing a dual wall storage tank for liquids comprising the steps of; producing a primary container for storing said liquid, said container defining an inner wall; applying adhesive to the exterior surface of said inner wall; positioning permeable geotextile fabric against said exterior surface of said inner wall so as to adhere said fabric to said inner wall; and then applying chemically curing liquid resin exteriorally to said fabric whereby said resin soaks partially into said fabric and, upon curing simultaneously forms an outer layer of cured resin; a combined layer of permeable geotextile fabric soaked with cured resin integrally joined to said outer layer so as to constitute together an outer wall capable of containing leakage of said fluid through said inner wall; an interstitial layer of unsoaked fabric disposed adjacent said inner wall, said interstitial layer permeable to leakage of said liquid through said inner wall of said primary container.

It is another aspect of this invention to provide a dual wall container for storing fluids comprising; an inner wall for storing said fluid; fabric disposed exteriorally against said inner wall, said fabric permeable to any leakage of said fluid through said inner wall; and an outer wall of cured resin penetrating partially into said fabric for containing any leakage of said fluid from said inner wall.

It is yet another aspect of this invention to provide a dual wall tank for storing fluids comprising; a primary container for storing said fluid, said container defining an inner wall; an intermediate layer of fabric disposed exteriorally against said inner wall, said intermediate layer permeable to leakage of said fluid from said inner wall; a layer of said fabric combined with cured resin adjacent said intermediate layer; and an outer wall of cured resin integral with said combined layer for containing leakage of said fluid through said inner wall.

Finally it is an aspect of this invention to provide a dual wall tank for storing liquids comprising; a primary container for storing said liquid, said container defining an inner wall; an interstitial layer of permeable geotextile fabric disposed against the exterior surface of said inner wall; a layer of said geotextile fabric soaked with cured resin adjacent said interstitial layer; an outer layer of cured resin integrally joined to said soaked layer and forming together therewith an outer wall for containing leakage of said liquid through said inner wall of said primary container.

DESCRIPTION OF THE DRAWINGS

These and other objects and features shall now be described in relation to the following drawings.

DESCRIPTION OF THE INVENTION

Like parts shall be given like numbers throughout the figures.

Figure 1:
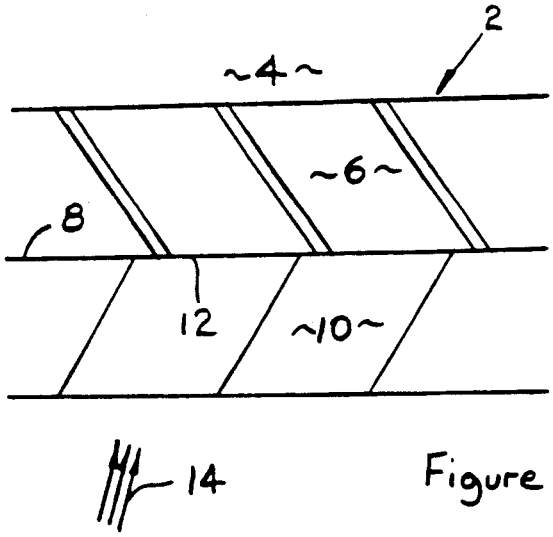
FIG. 1 is a partial cross-sectional view of a primary container prior to the application of resin in accordance with the invention described herein.

FIG. 1 is a partial cross-sectional view of a primary container 2 which is adapted to store a fluid 4. The shape of the container is not illustrated as the container 2 may take on a variety of shapes such as a cylindrical tank for example, or any other shape suitable for storing the desirable fluid. For example, the fluid may consist of a liquid such as gasoline, and gasoline tanks are usually cylindrical in cross-section.

More particularly, the primary container 2 defines an inner wall 6 which may be constructed of steel or fibreglass in a manner well known to those persons skilled in the art.

The inner wall 6 presents an exterior surface 8.

In accordance with the invention described herein a fabric 10 is positioned exteriorally against the inner wall 6. More particularly the fabric 10 is positioned against the exterior surface 8 of inner wall 6 in a manner so that the fabric does not become dislodged from the inner surface 6.

In one embodiment of the invention an adhesive 12 is applied to the exterior surface 8 of primary container 2 and the fabric 10 is glued to the exterior surface 8 of primary container 2. Relatively good results have been experienced by utilizing a solvent base adhesive applied to the exterior surface 8 of primary container 2. Except in the immediate vicinity of flanges on a tank (which is not shown) or other protrusions, no preparation of the exterior surface 8 of primary container 2 is necessary and accordingly the adhesive may be applied to a rusty surface or a surface which has mill scale. A light coat of adhesive may be applied by spraying or the like onto the exterior surface 8 in a sufficient manner so that the fabric 10 will adhere thereto. It is not necessary that the adhesive be applied continuously to the exterior surface 8 of primarily container 2 so long as enough adhesive is applied to glue the fabric to inner wall 6. In the immediate vicinity of said flanges or other protrusions (not shown) where it is anticipated that there will be direct contact between, the inner wall 6 and the outer wall 24 or 32 with no fabric 10, it is a preferred technique to abrasive blast (in the case of steel) or to thoroughly abrade with sandpaper (in the case of fibreglass) the said areas of direct contact.

Figure 2:
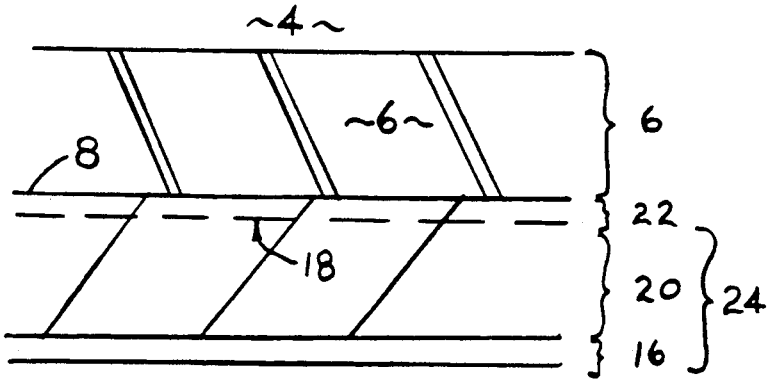
FIG. 2 is a partial cross-sectional view of a dual wall tank after the application and curing of resin in accordance with the invention described herein.

Thereafter liquid resin 14 is applied exteriorally to the fabric 10 in a manner so as to penetrate partially into the fabric 10 as best illustrated by hidden line 18 of FIG. 2; so that upon curing of the resin 14 an outer wall 24, is formed for containing any leakage of fluid 4 through the inner. More particularly outer wall 24 consists of a layer of resin only 16 integral with a layer of combined fabric and resin 20. Furthermore, an intermediate or interstitial layer 22 of fabric which does not contain resin 14 is also formed which layer 22 is permeable to leakage of fluid 4 through the inner wall 6. Furthermore, layer 22 is also permeable to any leakage of externally sourced liquids such as ground through the outer wall 24.

More particularly liquid resin 14 is applied exteriorally to the fabric 10 so as to penetrate partially into the fabric 10. When the resin 14 cures, an outer layer 16 of cured resin only is formed as well as a layer 20 of cured resin combined with and reinforced by fabric. The reinforced portion 20 and non-reinforced portion 16 of the outer wall 24 are adapted to contain leakage of any fluid 4 which may perforate or leak through inner wall 6. In other words the liquid resin 14 is applied so as to partially penetrate or soak into the fabric 10 whereby upon the curing of the resin 14 a combined layer 20 of resin reinforced with fabric is formed. The combined layer 20 is integrally connected or joined with the outer layer 16 of resin. The combined layer 20, because of its reinforced nature, provides strength to the outer layer 16 of cured resin and the two layers together constitute the outer wall 24.

Furthermore, an interstitial or intermediate layer 22 of fabric which does not contain any resin 14 is also formed. The interstitial or intermediate layer is disposed adjacent the exterior surface 8 of the inner wall 6 and is permeable to the migration of fluid 4 which may leak through inner wall 6. In the event of an externally sourced liquid such as water passing through the outer wall 24, the interstice 22 will be similarly permeable to the migration of such liquid. The migration of liquids, whether internally or externally sourced, will allow for the optional use of one of many well known and commercially available leak sensing devices.

It has been found that good results are produced when utilizing a fabric having a thickness of about 30 to 100 thousandths of an inch. In particular, a fabric identified in the trade as a goetextile fabric has been utilized. However, any fabric may be used provided it exhibits the following characteristics.

(a) the fabric is permeable to the liquid stored in the primary container 4;

(b) the fabric is capable of adhering to steel or to fibreglass;

(c) the density of the fabric is such that the resin does not completely penetrate or soak through the thickness of the fabric but does soak partially there through; and (d) the fabric is compatible with the resin 14 being applied thereto.

The liquid resin applied to the fabric 10 comprises a chemically curing liquid resin. Examples of such resin include polyurethane, polyester or epoxy which is preferably sprayed onto the exterior surface of the fabric 10.

Good results have been achieved by utilizing a chemically curing liquid resin having a viscosity between 100 and 100,000 centipois.

The degree of penetration of chemically curing liquid resin 14 may be controlled by selecting various densities and thicknesses of fabric 10 and by selecting the viscosity of resin 14 as well as the curing time of the resin 14. In other words, if the fabric 10 is dense, the resin 14 will not soak through as much. Furthermore, the lower the viscosity of resin utilized the higher degree of penetration of resin into the fabric 10. By increasing the density of fabric 10 the degree of penetration of resin decreases. The selection of a resin 14 with a faster curing time will also decrease the degree of penetration. Furthermore, if one increases the thickness of fabric 10, the tendency for the resin 14 to soak entirely there through becomes less. Moreover, urethane will set at most temperatures while polyester and epoxy tend to cure over a longer period in colder temperatures. The resin setting time will be a function of the composition of resin utilized and vary between one minute or several hours depending on the resin used.

The method described herein may be utilized to produce a dual wall tank by utilizing an existing primary container or tank 2 or by manufacturing the primary container. Once the fabric 10 is applied to the outer wall 8 of primary container 2, the resin 14 may either be applied exteriorally to the fabric 10 with the container resting on the ground or the container 2 may be rotated in a suitable apparatus so as to evenly distribute the resin 14 to the fabric 10.

Figure 3:
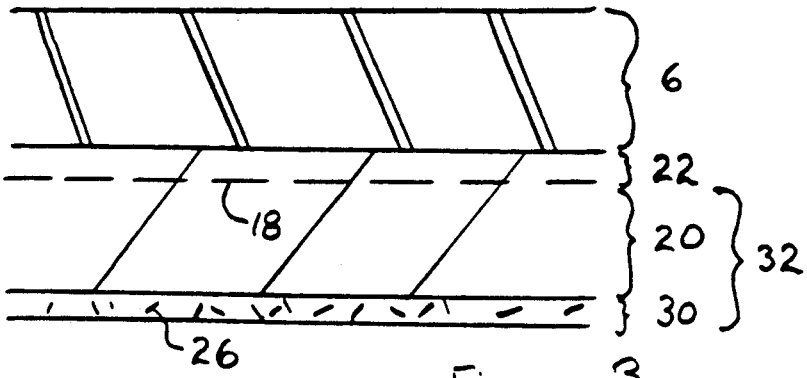
FIG. 3 is a partial cross-sectional view of a dual wall tank with chopped glass applied to the outer wall.

FIG. 3 illustrates another embodiment of the invention whereby a chopped glass fibre 26 or other suitable reinforcing means such as fibre glass matting or the like is applied to the exterior surface of fabric 10 along with the liquid resin 14 so as to form when cured an outer layer 30 of cured resin mixed with chopped glass 26. Such outer layer 30 is integrally connected or joined with the combined layer of resin and fabric 20 to form an outer wall 32 and is adapted to contain leakage of liquid through the inner wall 6 of primary container 2.

The chopped glass 26 or other reinforcing means could be added to enhance the impact strength of the outer layer 30.

It should be noted that the fabric 10 may either be applied over the entire exterior surface 8 of primary container 2 or the fabric 10 may be applied to a portion of the exterior surface 8 of primary container 2 which is desired to exhibit the dual wall characteristics described herein.

The thickness of the interstitial layer 22 may be selected as desired although optimal results have been achieved with an interstitial layer 22 having a thickness of about 1 to 125 thousandths of an inch.

By utilizing the method described herein, the geotextile fabric 10 functions in one step both as an interstitial layer 22 and as an reinforcement incorporated partially into and within the outer wall 24. The interstitial layer 22 acts as a passageway or wick which allows intruding liquids 4 which leak through inner wall 6 or outer wall 24 or 32 to migrate between the said inner and outer walls where they can be detected by one of many known liquid detection mean which communicate with the interstitial layer 22.

Accordingly, by utilizing the method described herein and particularly when resin 14 cures it simultaneously forms an outer layer 16, a combined layer 20, and an interstitial layer 22.

Although the preferred embodiments as well as the operation and use have been specifically described in relation to the drawings, it should be understood that variations in the preferred embodiments could be achieved by a skilled man in a trade without departing from the spirit of the invention. Accordingly, the invention should not be understood to be limited to the exact form revealed in the drawings.

The embodiments of the invention in which an exclusive property or privilege is claimed are defined as follows:

1. In a dual wall container for storing fluids comprising:

(a) inner wall means for storing said fluid;

(b) fabric means disposed exteriorally against said inner wall means, said fabric means permeable to leakage of said fluid through said inner wall means;

(c) outer wall means of cured resin means penetrating partially into said fabric means for containing leakage of said fluid from said inner wall means.

2. In a dual wall container as claimed in claim 1 wherein said cured resin means comprises polyurethane.

3. In a dual wall container as claimed in claim 1 wherein said cured resin means comprises polyester.

4. In a dual wall container as claimed in claim 1 wherein said cured resin means comprises epoxy.

5. In a dual wall container as claimed in claim 2, 3 or 4, wherein said fabric means comprises geotextile material.

6. In a dual wall container as claimed in claim 5, wherein said geotextile material is glued to said inner wall.

7. In a dual wall tank for storing fluids, comprising:

(a) a primary container for storing said fluid, said container defining inner wall means;

(b) an intermediate layer of fabric means disposed exteriorally against said inner wall means, said intermediate layer permeable to leakage of said fluid from said inner wall means;

(c) a layer of said fabric means combined with cured resin means adjacent said intermediate layer; and (d) an outer wall means of cured resin means integral with said combined layer for containing leakage of said fluid through said inner wall means of said primary container.

8. In a dual wall tank as claimed in claim 7 wherein said inner wall means is comprised of steel.

9. In a dual wall container as claimed in claim 7 wherein said inner wall means is comprised of fibreglass.

10. In a dual wall tank as claimed in claim 7 wherein said fabric means comprises geotextile fabric means.

11. In a dual wall tank for storing liquids comprising:

(a) a primary container for storing said liquid, said container defining an inner wall;

(b) an interstitial layer of permeable geotextile fabric means disposed against the exterior surface of said inner wall;

(c) a layer of said geotextile fabric means soaked with cured resin means adjacent said interstitial layer;

(d) an outer layer of cured resin means integrally joined to said soaked layer and together therewith outer wall means for containing leakage of said liquid through said inner wall of said primary container.

12. In a dual wall tank as claimed in claim 11, including adhesive means between said inner wall and said interstitial layer.

13. In a dual wall tank as claimed in claim 12 wherein said outer wall comprises a mixture of cured resin means and reinforcing means.

14. In a dual wall tank as claimed in claim 13 including liquid leakage detection means communicating with said interstitial layer.

15. In a dual wall tank as claimed in claim 14 wherein said geotextile fabric has a density in the range of 1 to 20 ounces per square yard.

* * * * *